US007019698B2

(12) United States Patent
Miyoshi et al.

(10) Patent No.: US 7,019,698 B2
(45) Date of Patent: Mar. 28, 2006

(54) GAP FEEDING TYPE ANTENNA UNIT

(75) Inventors: Akira Miyoshi, Tokyo (JP); Hisamatsu Nakano, 4-6-7-101, Jousuiminami-cho, Kodaira-shi, Tokyo (JP)

(73) Assignees: Mitsumi Electric Co., Ltd., Tokyo (JP); Hisamatsu Nakano, Kodaira (JP)

( * ) Notice: Subject to any disclaimer, the term of this patent is extended or adjusted under 35 U.S.C. 154(b) by 0 days.

(21) Appl. No.: 10/928,369

(22) Filed: Aug. 27, 2004

(65) Prior Publication Data

US 2005/0099339 A1 May 12, 2005

(30) Foreign Application Priority Data

Nov. 11, 2003 (JP) ..... 2003-381017

(51) Int. Cl.
*H01Q 1/38* (2006.01)

(52) U.S. Cl. ..... 343/700 MS; 343/702; 343/846

(58) Field of Classification Search ..... 343/700 MS, 343/846, 702, 824, 825, 848, 850; H01Q 1/38
See application file for complete search history.

(56) References Cited

U.S. PATENT DOCUMENTS

| | | | | |
|---|---|---|---|---|
| 3,815,141 A | | 6/1974 | Kigler | |
| 4,605,012 A | * | 8/1986 | Ringeisen et al. | 607/155 |
| 5,828,340 A | | 10/1998 | Johnson | |
| 5,847,682 A | * | 12/1998 | Ke | 343/752 |
| 5,952,970 A | | 9/1999 | Kawahata | |
| 6,157,344 A | * | 12/2000 | Bateman et al. | 343/700 MS |
| 6,424,309 B1 | | 7/2002 | Johnston et al. | |

FOREIGN PATENT DOCUMENTS

| | | |
|---|---|---|
| EP | 0 746 054 A1 | 12/1996 |
| JP | 7-94934 A | 4/1995 |
| JP | 10-190347 A | 7/1998 |

OTHER PUBLICATIONS

U.S. Appl. No. 10/874,910, filed Jun. 22, 2004, A. Miyoshi et al.

Shlager, K. L. et al.: "A Resistively Loaded Bowtie Antenna for Pulse Radiation: FDTD Analysis and Optimization." Antennas and Propagation Society International Symposium, 1993. AP-S, Digest Ann Arbor, MI, USA, Jun. 28-Jul. 2, 1993, New York, NY, USA, IEEE, Jun. 28, 1993, pp. 830-833, XP010132611, ISBN: 0-7803-1246-5.

* cited by examiner

*Primary Examiner*—Hoanganh Le
(74) *Attorney, Agent, or Firm*—Frishauf, Holtz, Goodman & Chick, P.C.

(57) ABSTRACT

A UWB antenna has an upper dielectric, a lower dielectric, and a conductive pattern sandwiched therebetween. The conductive pattern has a vertex apart from a feeding point with a predetermined gap. The conductive pattern has a reversed triangular portion having a right-hand taper part and a left-side taper part which widen from the feeding point at a predetermined angle toward a right-hand side surface and a left-hand side surface, respectively, and a semicircular portion having a base side being in contact with an upper side of the reversed triangular portion. The UWB antenna further has a feeding pattern connected to the feeding point, whereby carrying out feed from the feeding pattern to the conductive pattern by electromagnetic coupling.

8 Claims, 4 Drawing Sheets

$f = 6.0$ GHz $\Delta x = \Delta y = \Delta z = 1/125\lambda_{6.0} = 0.4\text{mm}$ $W = 0.432\lambda_6 = 54\Delta = 21.6\text{mm}$ $H_1 = 0.488\lambda_6 = 61\Delta = 24.4\text{mm}$ $H_2 = 0.152\lambda_6 = 0.253\lambda_{10.0} = 19\Delta = 7.6\text{mm}$ $B = 0.456\lambda_6 = 57\Delta = 22.8\text{mm}$ $S = 0.216\lambda_6 = 27\Delta = 10.8\text{mm}$ $d = 0.016\lambda_6 = 2\Delta = 0.8\text{mm}$ $g = 0.096\lambda_6 = 12\Delta = 4.8\text{mm}$ $T = 0.016\lambda_6 = 2\Delta = 0.8\text{mm}$ $\varepsilon_r = 4.4$

FIG. 2

GAP FEEDING TYPE ANTENNA UNIT

This application claims priority to prior Japanese patent application JP 2003-381017, the disclosure of which is incorporated herein by reference.

BACKGROUND OF THE INVENTION

This invention relates to an antenna unit and, more particularly, to an antenna for an ultra wideband (UWB).

The UWB technology means an ultra wideband radio technology like its name and is defined as any radio technology having a spectrum that occupies a bandwidth greater than 25 percent of the center frequency, or a bandwidth of at least 1.5 GHz. In a word, the UWB technology is technology for communicating using short pulses (normally each having a pulse width of 1 ns or less) of ultra wideband so as to start a revolution in radio technology.

A crucial difference between a conventional radio technology and the UWB technology is the presence or absence of a carrier wave. The conventional radio technology modulates a sinusoidal wave having a frequency called the carrier wave using various methods to transmit and receive data. On the other hand, the UWB technology does not the carrier wave. In the manner which is written in definition of the UWB technology, the UWB technology uses the short pulses of the ultra wideband.

Like its name, the UWB technology has a frequency band of the ultra wideband. On the other hand, the conventional radio technology has only a narrow frequency band. This is because it is possible for the narrow frequency band to put electric waves to practical use. The electric waves are a finite resource. The reason whey the UWB technology is widely noticed in spite of the ultra wideband is output energy of each frequency. The UWB technology has a vary small output each frequency in place of a wide frequency band. Inasmuch as the output of the UWB technology has magnitude so as to be covered with noises, the UWB technology reduces interference with other wireless spectra. In the United States, the Federal Communications Commission (FCC) has mandated that UWB radio transmissions can legally operate in range from 3.1 GHz up to 10.6 GHz, at a limited transmit power of −4.1 dBm/MHz.

In addition, antennas basically use a resonance phenomenon. The antenna has a resonance frequency which is determined by its length, it is difficult for the UWB including a lot of frequency components to make the antenna for UWB resonate. Accordingly, the wider the frequency band of the electric wave to be transmitted is, the more difficult it makes a plan for the antenna for UWB.

For example, patch antennas are known as small-sized antennas in the art. As one of the patch antennas, a compact plane patch antenna is disclosed, for example, in JP 07-094934 A. According to JP 07-094934 A, the compact plane patch antenna has high infrequency temperature characteristics and high reliability by using magnesium titanate ceramic having comparatively high dielectric constant as a main material for a dielectric material and adding the proper quantity of lithium niobate, alumina, manganese oxide, etc., individually or their combination at ions to the main material to mold the antenna. In addition, a patch antenna device capable of coping with a plurality of frequencies is known, for example, in JP 10-190347 A.

However, the patch antennas are unsuitable for the UWB antennas because the patch antennas have no wideband.

On the other hand, Taiyo Yuden Co. Ltd. has successfully developed a very miniaturized ceramic chip antenna having a size of 10×8×1 mm for ultra wideband applications. Since UWB technology was released by the FCC for commercial use, it has been hailed as the short-range wires-communication standard of the future. For one thing, it promises to simultaneously provide a high data rate and low power consumption. By sending very low-power pulses below the transmission-noise threshold, UWB also avoids interference. By developing the antenna, is has become the responsibility of the wireless industry to help UWB make the transition from military applications to widespread commercial use for connecting at a very high speed data between digital devices such as PDP (plasma display panel) television, a digital camera, or the like.

In addition, such a UWB antenna can be used for various purposes such as Bluetooth (registered trademark), wireless LAN (local area network), or the like.

Bluetooth (registered trademark) technology is a cutting-edge open specification that enables short-range wireless connections between desktop and notebook computers, handhelds, personal digital assistants, mobile phones, camera phones, printers, digital cameras, handsets, keyboards and even a computer mouse. Bluetooth wireless technology uses a globally available frequency band (2.4 GHz) for worldwide compatibility. In a nutshell, Bluetooth technology unplugs your digital peripherals and makes cable clutter a thing of the past.

The wireless LAN is a LAN using a transmission path except for a wire cable, such as electric waves, infrared rays, or the like.

In the manner which is described above, the conventional antenna such as a patch antenna is disadvantageous in that it is difficult to widen the band and wave distortions (wave expansion) occur.

On the other hand, the present co-inventors have been developed an antenna unit of a direct-feeding type and this assignee already file an application at Sep. 18, 2003 as Japanese Patent Application No. 2003-325858 which corresponds to European Patent Application No. 04253764.7 (Jun. 23, 2004) and to U.S. patent application Ser. No. 10/874,910 (Jun. 22, 2004). However, the direct-feeding has a poor matching characteristic and a large return loss.

SUMMARY OF THE INVENTION

It is therefore an object of the present invention to provide an antenna unit which has a good matching characteristic.

It is another object of the present invention to provide an antenna unit which has a small return loss.

Other objects of this invention will become clear as the description proceeds.

According to a first aspect of this invention, an antenna unit comprises an upper dielectric having an upper surface, a lower dielectric having a bottom surface, and a conductive pattern sandwiched between the upper dielectric and the lower dielectric. The conductive pattern has a vertex apart from a feeding point with a predetermined gap. The feeding point is formed at a substantially center portion of a front of the antenna unit. The conductive pattern comprises a conductive reversed triangular portion having a conductive right-hand taper part and a conductive left-hand taper part which widen from the vertex at a predetermined angle toward a right-hand side and a left-hand side, respectively, and a conductive semicircular portion having a base side being in contact with an upper side of the conductive reversed triangular portion. The antenna unit further comprises a feeding pattern connected to the feeding point, thereby feeding from the feeding pattern to the conductive pattern by electromagnetic coupling.

In the antenna unit according to the first aspect of this invention, the feeding pattern may be formed on at least one of the upper surface and the bottom surface. The feeding pattern may preferably have a configuration so as to minimize a size of the conductive pattern. Specifically, the feeding pattern may comprise a feeding reversed triangular portion having a feeding right-hand taper part and a feeding left-hand taper part which widen from the feeding point at the predetermined angle toward the right-hand side and the left-hand side, respectively, and a feeding semicircular portion having a base side being in contact with an upper side of the feeding reversed triangular portion.

According to a second aspect of this invention, an antenna unit comprises an upper dielectric having an upper surface, a lower dielectric having a bottom surface, and a conductive pattern sandwiched between the upper dielectric and the lower dielectric. The conductive pattern has a vertex apart from a feeding point with a predetermined gap. The feeding point is formed at a substantially center portion of a front of the antenna unit. The conductive pattern comprises a conductive reversed triangular portion having a conductive right-hand taper part and a conductive left-hand taper part which widen from the vertex at a predetermined angle toward a right-hand side and a left-hand side, respectively, and a conductive rectangular portion having a base side being in contact with an upper side of the conductive reversed triangular portion. The antenna unit further comprises a feeding pattern connected to the feeding point, thereby feeding from the feeding pattern to the conductive pattern by electromagnetic coupling.

In the antenna unit according to the second aspect of this invention, the feeding pattern may be formed on at least one of the upper surface and the bottom surface. The feeding pattern may desirably have a configuration so as to minimize a size of the conductive reversed triangular portion. Specifically, the feeding pattern may comprise a feeding reversed triangular portion having a feeding right-hand taper part and a feeding left-hand taper part which widen from the feeding point at the predetermined angle toward the right-hand side and the left-hand side, respectively.

BRIEF DESCRIPTION OF THE DRAWINGS

FIG. 2 collectively shows various sizes and parameters of the antenna unit illustrated in FIGS. 1A through 1C;

DESCRIPTION OF THE PREFERRED EMBODIMENTS

Figure 1A:
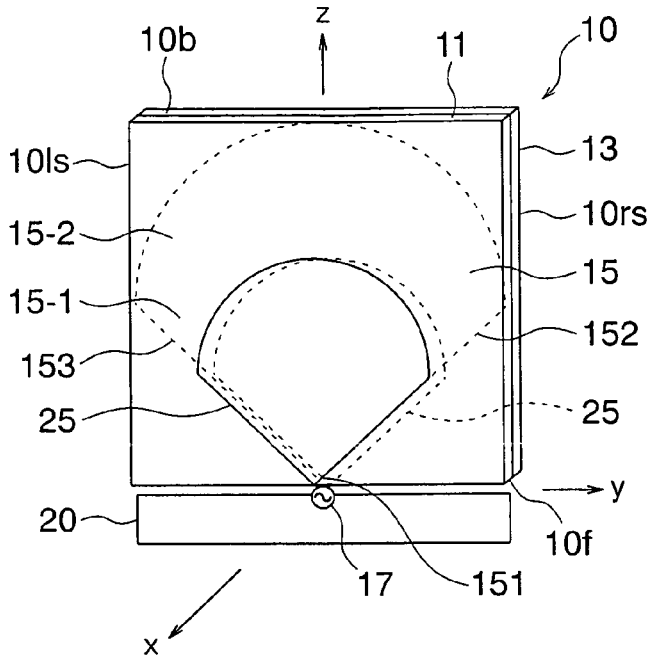
FIG. 1A is a perspective view of an antenna unit according to a first embodiment of this invention.
Figure 1B:
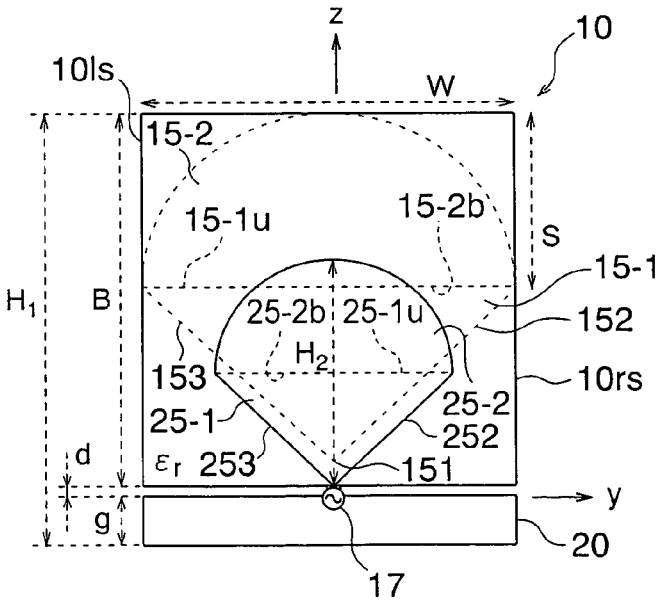
FIG. 1B is a plan view of the antenna unit illustrated in FIG. 1A.
Figure 1C:
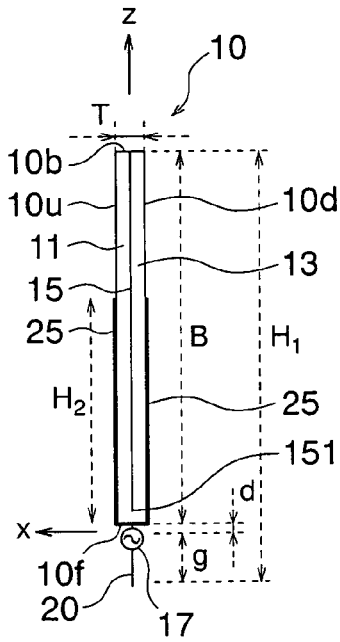
FIG. 1C is a vertical sectional side view of the antenna unit illustrated in FIG. 1A.

Referring to FIGS. 1A, 1B and 1C, the description will proceed to a UWB antenna 10 as an antenna unit according to a first embodiment of the present invention. FIG. 1A is a perspective view of the UWB antenna 10. FIG. 1B is a plan view of the UWB antenna 10. FIG. 1C is a vertical sectional side view of the UWB antenna 10.

The UWB antenna 10 has, as whole exterior appearance, configuration of a rectangular parallelepiped (rectangular plate) having a length B, a width W, and a thickness T. In the example being illustrated, the length B is equal to 22.8 mm, the width W is equal to 21.6 mm, and the thickness T is equal to 0.8 mm.

The UWB antenna 10 has an upper surface 10*u*, a bottom surface 10*d*, a front surface 10*b*, a back surface 10*b*, a right-hand side surface 10*rs*, and a left-hand side surface 10*ls*.

The UWB antenna 10 comprises an upper rectangular dielectric 11 having the upper surface 10*u*, a lower rectangular dielectric 13 having the bottom surface 10*d*, and a conductive pattern 15 sandwiched between the upper rectangular dielectric 11 and the lower rectangular dielectric 13. Each of the upper rectangular dielectric 11 and the lower rectangular dielectric 13 has a length B, a width W, and a thickness or height T/2. The conductive pattern 15 is made of material, for example, of silver paste and has a thickness of about 8 μm.

In addition, the upper rectangular dielectric 11 and the lower rectangular dielectric 13 have relative dielectric constant $\in r$. In the example being illustrated, the relative dielectric constant $\in r$ is equal to 4.4. Each of the upper rectangular dielectric 11 and the lower rectangular dielectric 13 comprises, for example, a ceramic plate.

The conductive pattern 15 has a vertex 151 apart from a feeding point 17 with a predetermined gap. The feeding point 17 is formed at a substantially center portion of the front surface 10*f*. The conductive pattern 15 has a conductive right-hand taper part 152 and a conductive left-hand taper part 153 which widen from the vertex 151 at a predetermined angle toward the right-hand side surface 10*rs* and the left-hand side surface 10*ls*, respectively. In the example being illustrated, the predetermined angle is equal to 45 degrees.

In FIG. 1, the feeding point 17 is the origin of the coordinate axes defined by an x-axis direction, a y-axis direction, and a z-axis direction which are perpendicular to each other. The x-axis direction indicates up and down, the y-axis direction indicates right and left, and the z-axis direction indicates back and forth.

That is, the conductive pattern 15 comprises a conductive reversed triangular portion 15-1 formed at the front surface 10*f* side and a conductive semicircular portion 15-2 formed at the back surface 10*b* side. The conductive reversed triangular portion 15-1 has the conductive right-hand taper portion 152, the conductive left-hand taper portion 153, and an upper side 15-1*u*. The conductive semicircular portion 15-2 has a base side 15-2*b*. The upper side 15-1*u* of the conductive reversed triangular portion 15-1 and the base side 15-2*b* of the conductive semicircular portion 15-2 are in contact with each other. The conductive semicircular portion 15-2 has a radius S while the conductive reversed triangular portion 15-1 has a height (B-S). In the example being illustrated, the radius S is equal to 0.8 mm.

The feeding point 17 of the UWB antenna 10 is electrically connected to a ground part 20 which has a length g and a width W. In the example being illustrated, the length g is equal to 4.8 mm.

The illustrated UWB antenna 10 further comprises a feeding pattern 25 connected to the feeding point 17. That is, feeding from the feeding pattern 25 to the conductive pattern 15 is carried out by electromagnetic coupling. In other words, a gap feeding is carried out in the UWB antenna 10. Specifically, the feeding pattern 25 and the conductive pattern 15 are apart from each other by a gap of T/2 and the feeding is carried out at a portion where the feeding pattern 25 and the conductive pattern 15 overlap each other. This portion has capacity such as a capacitance and the feeding from the feeding pattern 25 to the conductive pattern 15 is carried.

In the example being illustrated, the feeding pattern 25 is formed on both sides of the upper surface 10*u* and the bottom surface 10*d*. However, the feeding pattern 25 may be formed on one side of either the upper surface 10*u* or the bottom surface 10*d*. That is, the feeding pattern 25 may be formed on at least one of the upper surface 10*u* and the bottom surface 10*d*.

In addition, the illustrated feeding pattern 25 substantially has a configuration where the conductive pattern 15 is miniaturized. That is, the feeding pattern 25 has a configuration so as to minimize a size of the conductive pattern 15. Specifically, the feeding pattern 25 has a feeding right-hand taper part 252 and a feeding left-hand taper part 253 which widen from the feeding point 17 at the predetermined angle toward the right-hand side surface 10*rs* and the left-hand side surface 10*ls*, respectively. The feeding pattern 25 comprises a feeding reversed triangular portion 25-1 formed at the front surface 10*f* side and a feeding semicircular portion 25-2 formed at the back surface 10*b* side. The feeding reversed triangular portion 25-1 has the feeding right-hand taper part 252, the feeding left-hand taper part 253, and an upper side 25-1*u*. The feeding semicircular portion 25-2 has a base side 25-2*b*. The upper side 25-1*u* of the feeding reversed triangular portion 25-1 and the base side 25-2*b* of the feeding semicircular portion 25-2 are in contact with each other.

In the example being illustrated, a length size $H_1$ obtained by adding the ground part 20 and the UWB antenna 10 is equal to 24.4 mm. In addition, a length size $H_2$ of the feeding pattern 25 is equal to 7.6 mm. The UWB antenna 10 and the ground part 20 are opposite to each other with a distance d which is equal to 0.8 mm.

FIG. 2 collectively shows various sizes of the USB antenna 10 and parameters thereof.

Figure 3:
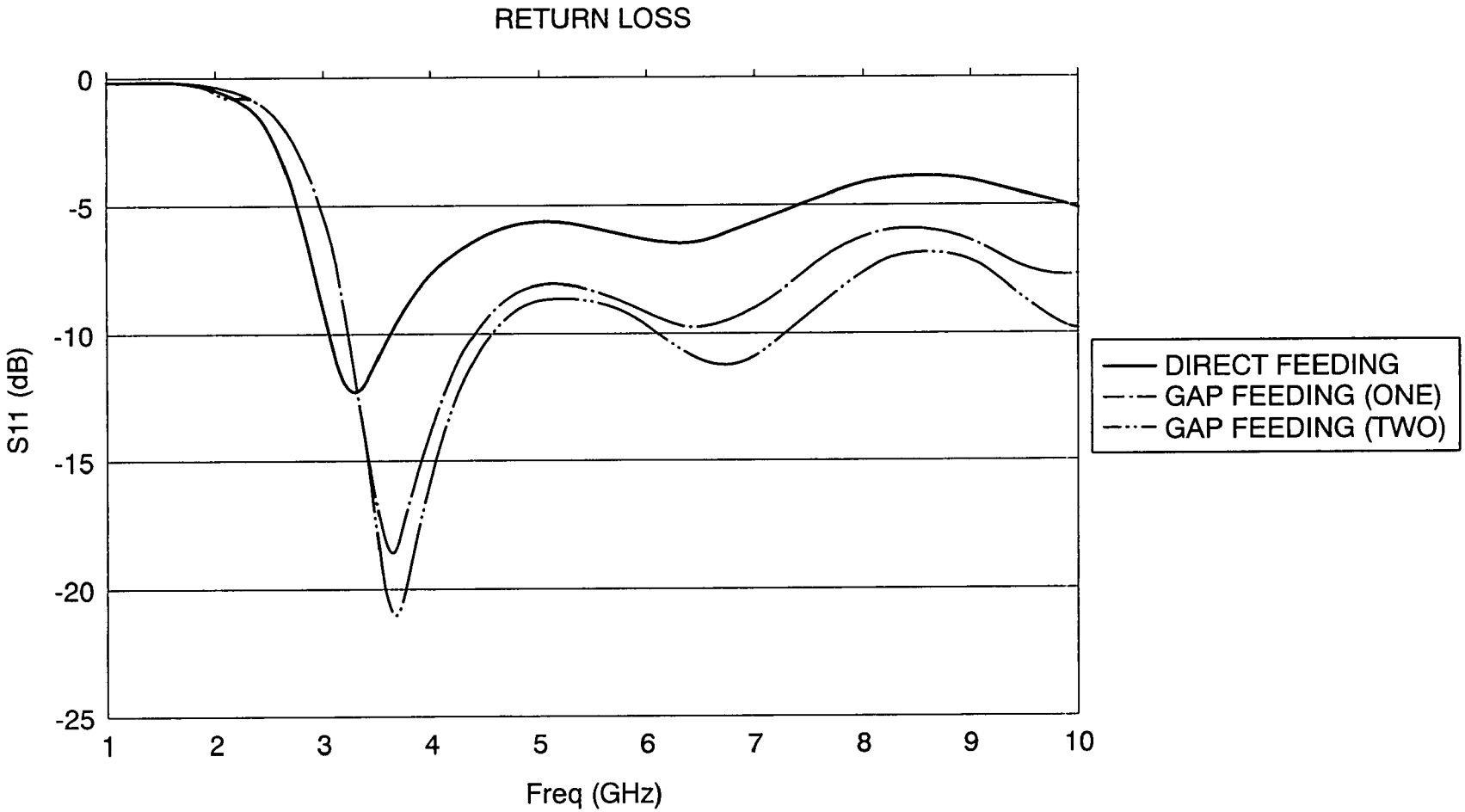
FIG. 3 is a characteristic view showing antenna characteristics of a direct feeding type antenna unit, of a gap feeding type antenna unit provided with only one feeding pattern, and of a gap feeding type antenna unit provided with two feeding patterns illustrated in FIGS. 1A through 1C.

FIG. 3 shows antenna characteristics of a direct feeding type UWB antenna, of a gap feeding type UWB antenna provided with only one feeding pattern 25, and of a gap feeding type UWB antenna 10 provided with two feeding patterns 25 illustrated in FIG. 1. In FIG. 3, the abscissa represents a frequency (GHz) and the ordinate represents S11 (dB) of S parameters.

The S parameters are defined by a following expression (1):

$$\begin{pmatrix} b1 \\ b2 \end{pmatrix} = \begin{pmatrix} S11 & S12 \\ S21 & S22 \end{pmatrix} \begin{pmatrix} a1 \\ a2 \end{pmatrix}$$

where a1 and a2 represent input voltages and b1 and b2 represent reflected voltages. From the expression (1), S11 and S21 can be calculated when a2=0 in the expression (1) and S12 and S22 can be calculated when a1=0 in the expression (1). S11 and S22 represent reflection characteristics and S12 and S21 represent transmission characteristics. Inasmuch as the S parameters are represented by the ratios of the input voltages to the reflected voltages, it is possible to easily calculate the S parameters in also a micro wave band.

That is, S11 in the S parameters represents a reflection coefficient. When the reflection coefficient S11 is small, it indicates that matching is achieved as the antenna. The reflection coefficient S11 is also called a return loss.

It is understood from FIG. 3 that the gap feeding type UWB antennas have the return loss which is smaller than that of the direct feeding type UWB antenna in a frequency range of about 3 GHz or more. In addition, it is understood from FIG. 3 that the gap feeding type UWB antenna provided with the two feeding patterns 25 has the return loss which is smaller than that of the gap feeding type UWB antenna provided with the one feeding pattern 25.

Figure 4:
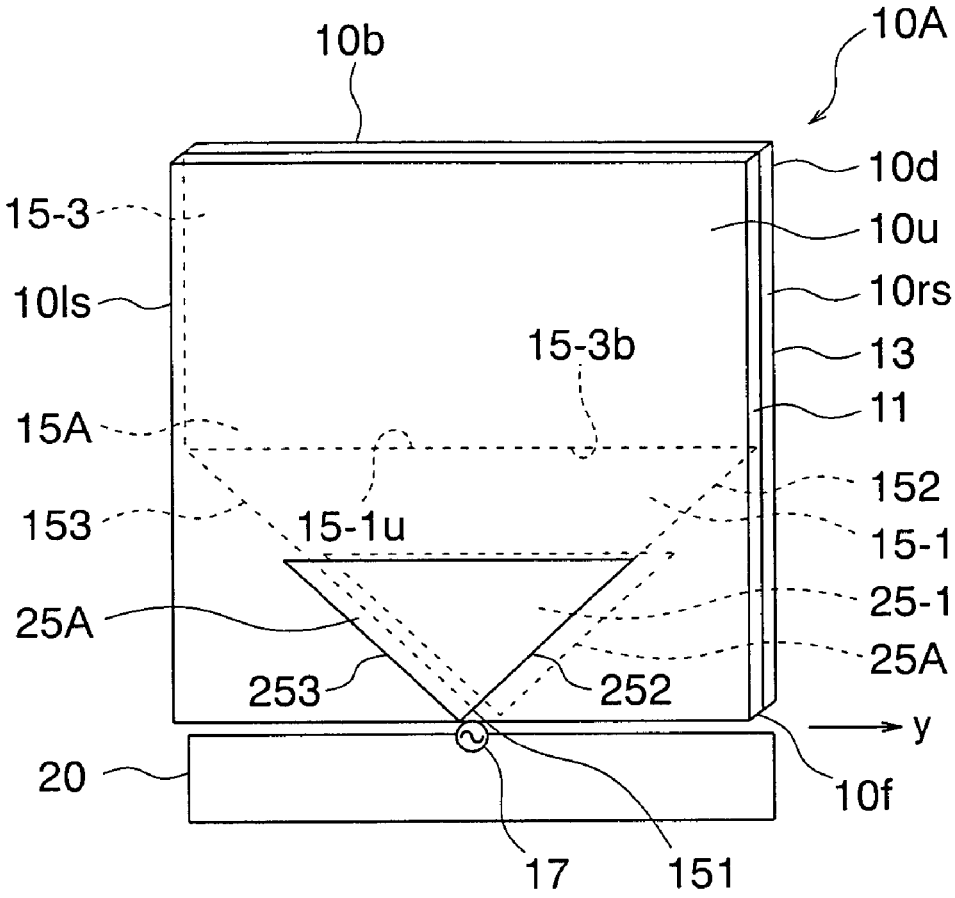
FIG. 4 is a perspective view of an antenna unit according to a second embodiment of this invention.

Referring to FIG. 4, the description will proceed to a UWB antenna 10A as an antenna unit according to a second embodiment of the present invention. FIG. 4 is a perspective view of the UWB antenna 10A.

The illustrated UWB antenna 10A is similar in structure to the UWB antenna 10 illustrated in FIGS. 1A through 1C except that the UWB antenna 10A comprises a conductive pattern including a conductive rectangular portion 15-3 in lieu of the conductive semicircular portion 15-2 and a reversed triangular shaped feeding pattern 25A on behalf of the substantially fan-shaped feeding pattern 25.

Specifically, the conductive rectangular portion 15-3 has a base side 15-3*b*. The upper side 15-1*u* of the conductive reversed triangular portion 15-1 and the base side 15-3*b* of the conductive rectangular portion 15-3 are in contact with each other. The feeding pattern 25A comprises the feeding reversed triangular portion 25-1 having the feeding right-hand taper part 252 and the feeding left-hand taper part 253 which widen from the feeding point 17 at the predetermined angle toward the right-hand side surface 10*rs* and the left-hand side surface 10*ls*, respectively. In other words, the feeding pattern 25A has a configuration so as to minimize a size of the conductive reversed triangular portion 15-1.

In the example being illustrated, the feeding pattern 25A is formed on both sides of the upper surface 10*u* and the bottom surface 10*d*. However, the feeding pattern 25A may be formed on one side of either the upper surface 10*u* or the bottom surface 10*d*. That is, the feeding pattern 25A may be formed on at least one of the upper surface 10*u* and the bottom surface 10*d*.

The present co-inventors confirmed that the UWB antenna 10A has an antenna characteristic which is similar to that of the UWB antenna 10 illustrated in FIGS. 1A through 1C.

While this invention has thus far been described in conjunction with a few preferred embodiments thereof, it will now be readily possible for those skilled in the art to put this invention into various other manners.

What is claimed is:

1. An antenna unit comprising:

an upper dielectric having an upper surface;

a lower dielectric having a bottom surface;

a conductive pattern sandwiched between said upper dielectric and said lower dielectric, said conductive pattern having a vertex apart from a feeding point with a predetermined gap, said feeding point being formed at a substantially center portion of a front of said antenna unit, said conductive pattern comprising a conductive reversed triangular portion having a conductive right-hand taper part and a conductive left-hand taper part which widen from the vertex at a predetermined angle toward a right-hand side and a left-hand side, respectively, and a conductive semicircular portion having a base side being in contact with an upper side of said conductive reversed triangular portion; and a feeding pattern connected to the feeding point, thereby feeding from said feeding pattern to said conductive pattern by electromagnetic coupling.

2. The antenna unit as claimed in claim 1, wherein said feeding pattern is formed on at least one of said upper surface and said bottom surface.

3. The antenna unit as claimed in claim 1, wherein said feeding pattern has a configuration so as to minimize a size of said conductive pattern.

4. The antenna unit as claimed in claim 3, wherein said feeding pattern comprises a feeding reversed triangular portion having a feeding right-hand taper part and a feeding left-hand taper part which widen from the feeding point at the predetermined angle toward the right-hand side and the left-hand side, respectively, and a feeding semicircular portion having a base side being in contact with an upper side of said feeding reversed triangular portion.

5. An antenna unit comprising:

an upper dielectric having an upper surface;

a lower dielectric having a bottom surface;

a conductive pattern sandwiched between said upper dielectric and said lower dielectric, said conductive pattern having a vertex apart from a feeding point with a predetermined gap, said feeding point being formed at a substantially center portion of a front of said antenna unit, said conductive pattern comprising a conductive reversed triangular portion having a conductive right-hand taper part and a conductive left-hand taper part which widen from the vertex at a predetermined angle toward a right-hand side and a left-hand side, respectively, and a conductive rectangular portion having a base side being in contact with an upper side of said conductive reversed triangular portion; and a feeding pattern connected to the feeding point, thereby feeding from said feeding pattern to said conductive pattern by electromagnetic coupling.

6. The antenna unit as claimed in claim 5, wherein said feeding pattern is formed on at least one of said upper surface and said bottom surface.

7. The antenna unit as claimed in claim 5, wherein said feeding pattern has a configuration so as to minimize a size of said conductive reversed triangular portion.

8. The antenna unit as claimed in claim 7, wherein said feeding pattern comprises a feeding reversed triangular portion having a feeding right-hand taper part and a feeding left-hand taper part which widen from the feeding point at the predetermined angle toward the right-hand side and the left-hand side, respectively.

* * * * *